US009914303B2

(12) United States Patent
Kudo

(10) Patent No.: US 9,914,303 B2
(45) Date of Patent: Mar. 13, 2018

(54) LIQUID EJECTING HEAD

(71) Applicant: Seiko Epson Corporation, Tokyo (JP)

(72) Inventor: Yasuyuki Kudo, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/461,679

(22) Filed: Mar. 17, 2017

(65) Prior Publication Data

US 2017/0266967 A1 Sep. 21, 2017

(30) Foreign Application Priority Data

Mar. 18, 2016 (JP) ..... 2016-054947

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
See application file for complete search history.

(56) References Cited

U.S. PATENT DOCUMENTS 9,421,782 B2 * 8/2016 Okuno ..... B41J 2/17526
9,511,597 B2 * 12/2016 Tsukahara ..... B41J 2/17513
9,555,641 B2 * 1/2017 Miyamoto ..... B41J 2/17513

FOREIGN PATENT DOCUMENTS

JP 2007-232194 A 9/2007
JP 2010-228148 A 10/2010

* cited by examiner

*Primary Examiner* — Lamson Nguyen
(74) *Attorney, Agent, or Firm* — Harness, Dickey & Pierce, P.L.C.

(57) ABSTRACT

A liquid ejecting head includes a first member on which a flexible members is arranged, a second member having a facing surface facing the flexible member, an elastic body that is interposed between the flexible member and the facing surface, a first support portion disposed on the flexible member which supports one end of the elastic body, a second support portion disposed on the facing surface which has a recess of which a side surface has a tapered portion formed therein to guide the other end of the elastic body toward a bottom surface of the recess, and a protruding portion that is disposed on either the flexible member or the facing surface and that becomes interposed between the flexible member and the facing surface around the periphery of the recess when the flexible member is flexibly bent toward the facing surface.

20 Claims, 10 Drawing Sheets

LIQUID EJECTING HEAD

BACKGROUND

1. Technical Field

The present invention relates to a technique for ejecting liquid such as ink or the like onto a medium.

2. Related Art

In a liquid ejecting apparatus, such as an ink jet printer, in which a plurality of constituent members are bonded to one another to form a flow path, a liquid ejecting head that ejects liquid circulating in the flow path from nozzles has been proposed. A plurality of elastic bodies, such as coil springs, for example, are installed between the constituent members of the liquid ejecting head. In a liquid ejecting head in JP-A-2010-228148, for example, the constituent members have between them multiple arrangements where an elastic body is installed between a flexible member (a diaphragm) and a recess on a constituent member facing the flexible member. To install the plurality of elastic bodies at the same time in this configuration, a constituent member should be stacked on the flexible member in such a manner that a protruding portion on the flexible member is inserted into the inner side of one end of each elastic body to support the elastic body and that the outer side of the other end of each elastic body is inserted into the recess.

When the plurality of elastic bodies are installed at the same time in the configuration in JP-A-2010-228148, however, there is a possibility of causing a faulty installation. The elastic body supported by the protruding portion on the flexible member may be at an angle, for example. The larger the angle is, the more likely the constituent member that is stacked is to be caught by an edge of the recess, thereby causing a faulty installation. Moreover, in the configuration in JP-A-2010-228148, when the flexible member is flexibly bent, the protruding portion on the flexible member enters the recess of the constituent member together with the elastic body. This means that there is also a problem that the flexible member is likely to cling to the constituent member.

SUMMARY

An advantage of some aspects of the invention is that it facilitates installation of an elastic body while preventing clinging of a flexible member.

A liquid ejecting apparatus according to an aspect of the invention includes a first member on which a plurality of flexible members are arranged, a second member having a facing surface facing each flexible member of the plurality of flexible members, an elastic body interposed between the flexible member and the facing surface, a first support portion that supports one end of the elastic body, a second support portion that supports the other end of the elastic body, and a protruding portion that is disposed on either the flexible member or the facing surface. The second member is stacked on the first member. The first support portion is disposed on the flexible member. The second support portion, which is disposed on the facing surface, has a recess into which the other end of the elastic body is inserted. A side surface of the recess has a tapered portion formed therein to guide the other end of the elastic body toward a bottom surface of the recess. The protruding portion becomes interposed between the flexible member and the facing surface around the periphery of the recess when the flexible member is flexibly bent toward the facing surface. According to the above configuration, the tapered portion is formed on the side surface of the recess of the second support portion to guide the other end of the elastic body toward the bottom surface of the recess. Thus, even when shifted in position, the other end of the elastic body is guided along the tapered portion toward the bottom surface, thereby enabling the elastic body to be installed normally. In addition, the protruding portion that is disposed so as to become interposed between the flexible member and the facing surface around the periphery of the recess can prevent the flexible member from clinging to the facing surface when the flexible member is flexibly bent toward the facing surface. As a result, the apparatus can facilitate installation of the elastic body while preventing clinging of the flexible member.

It is preferable that the protruding portion have a width across an opening edge of the recess from an inner side to an outer side of the opening edge with the center of the width of the protruding portion being outside the opening edge of the recess. According to the above configuration, the protruding portion is less likely to incline inwardly from the opening edge when the protruding portion abuts against the periphery of the recess. It is thus less likely that the protruding portion will enter the recess.

It is preferable that the protruding portion be disposed so as to protrude from the flexible member and abut against the periphery of the recess when the flexible member is flexibly bent toward the facing surface. According to the above configuration, it is possible to prevent the flexible member from clinging to the facing surface.

It is preferable that the protruding portion be disposed on the first support portion to support the one end of the elastic body. According to the above configuration, it is possible to support the one end of the elastic body by use of the protruding portion; a separate structure does not need to be provided on the first support portion in order to support the one end of the elastic body.

It is preferable that the protruding portion be placed outside the first support portion and be brought into abutment with the outside of the opening edge of the recess. According to the above configuration, the protruding portion is brought into abutment with the outside of the opening edge of the recess; it is thus possible to prevent the flexible member from clinging to the facing surface.

BRIEF DESCRIPTION OF THE DRAWINGS

The invention will be described with reference to the accompanying drawings wherein like numbers reference like elements.

DESCRIPTION OF EXEMPLARY EMBODIMENTS

First Embodiment

Figure 1:
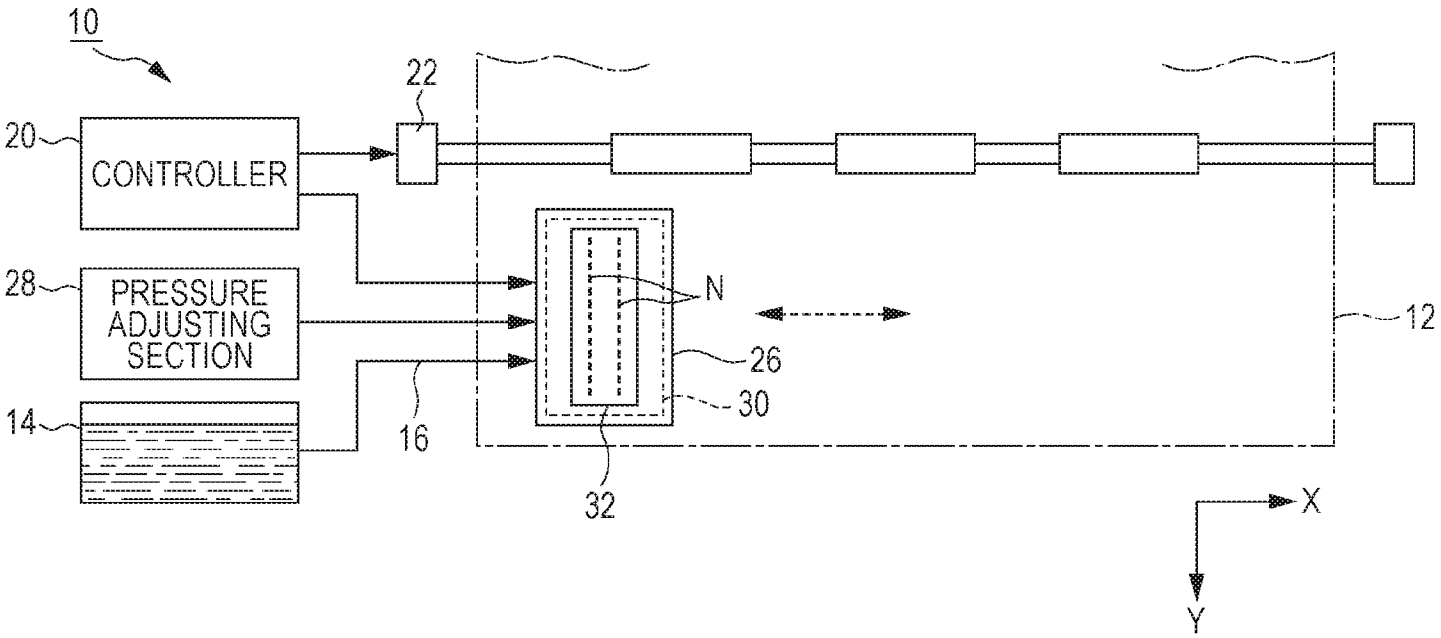
FIG. 1 is a diagram illustrating the structure of a liquid ejecting apparatus according to a first embodiment of the invention.

FIG. 1 is a diagram illustrating part of the structure of a liquid ejecting apparatus 10 according to a first embodiment of the invention. The liquid ejecting apparatus 10 according to the first embodiment is an ink jet printing apparatus that ejects liquid exemplified by ink onto a medium 12 such as print paper or the like. The liquid ejecting apparatus 10 illustrated in FIG. 1 includes a controller 20, a transport mechanism 22, a liquid ejecting head 30, a carriage 26, and a pressure adjusting section 28. A liquid container (cartridge) 14 that stores ink is installed in the liquid ejecting apparatus 10. Ink is supplied from the liquid container 14 via a liquid supply tube 16 to the liquid ejecting head 30.

The controller 20 comprehensively controls individual components of the liquid ejecting apparatus 10. The transport mechanism 22 transports the medium 12 in a Y direction under the control of the controller 20. The liquid ejecting head 30 includes a liquid ejecting section 32. The liquid ejecting section 32 ejects ink from each of nozzles N onto the medium 12 under the control of the controller 20. The liquid ejecting section 32 contains a plurality of sets of pressure chambers and piezoelectric elements (not illustrated) corresponding to different nozzles N. Ink in the pressure chambers is ejected from each nozzle N by supplying a drive signal to vibrate the piezoelectric elements thereby causing the pressure in the pressure chambers to change.

The liquid ejecting head 30 is mounted on the carriage 26. The controller 20 causes the carriage 26 to reciprocate in an X direction intersecting the Y direction. In parallel with the transport of the medium 12 performed by the transport mechanism 22 and the repeated reciprocating motion of the carriage 26, the liquid ejecting section 32 ejects ink onto the medium 12, thereby causing a desired image to be created on a surface of the medium 12.

Figure 2:
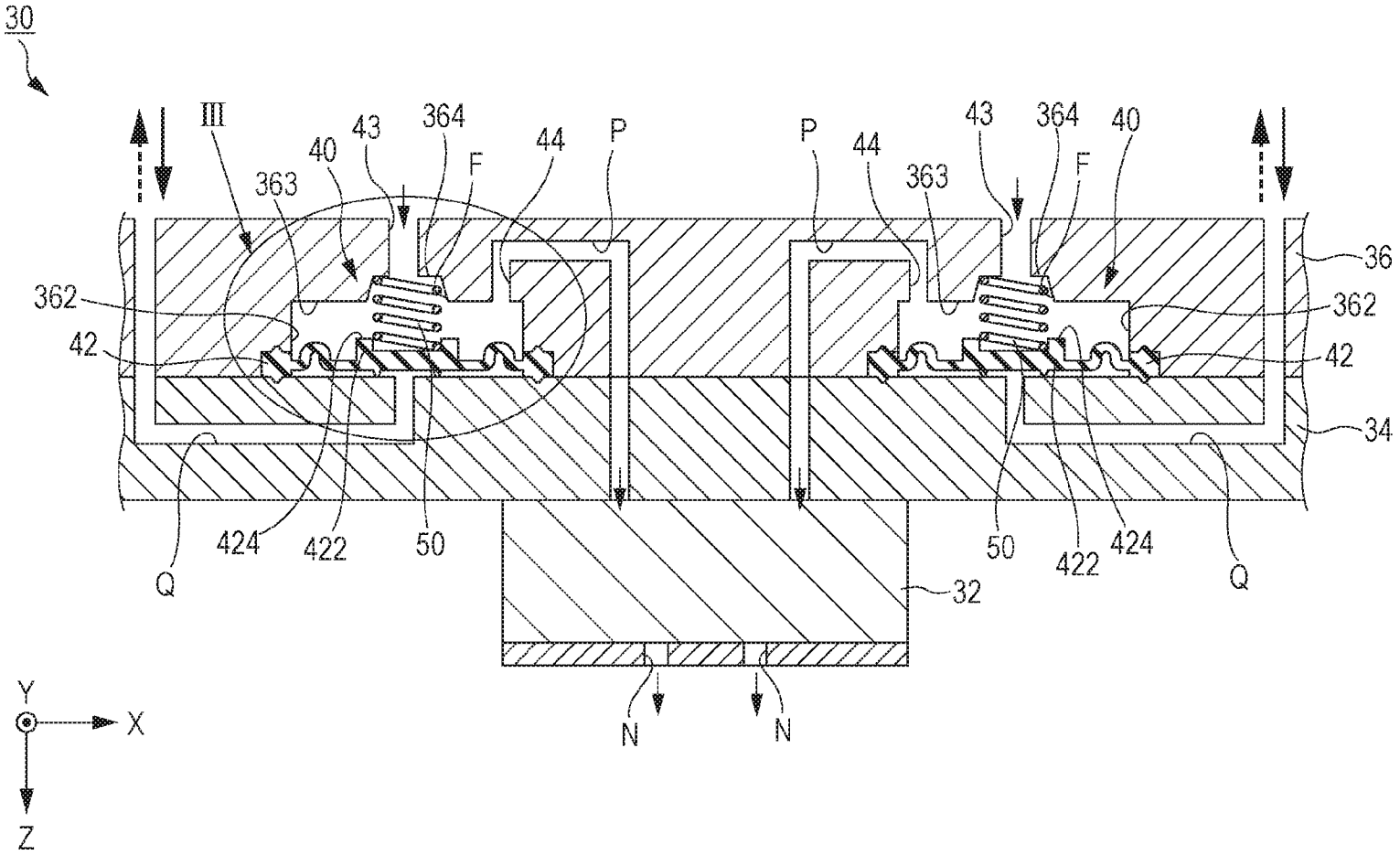
FIG. 2 is a cross-sectional view of a liquid ejecting head.

FIG. 2 is a cross-sectional view illustrating part of the structure of the liquid ejecting head 30. A Z direction illustrated in FIG. 2 is perpendicular to an X-Y plane. As illustrated in FIG. 2, the liquid ejecting head 30 in this embodiment has the liquid ejecting section 32, a first member (first flow path member) 34, and a second member (second flow path member) 36 which are stacked from below in this order (sequentially from the positive-Z-direction side to the negative-Z-direction side). The first member 34 and the second member 36 have a plurality of liquid flow paths P and a plurality of gas flow paths Q formed therein. The liquid flow paths P are flow paths through which ink from the liquid container 14 is supplied to the liquid ejecting section 32. The gas flow paths Q are flow paths of gas (for example, air) that communicate with the pressure adjusting section 28. The thin solid-line arrow in FIG. 2 denotes the flow of ink in the liquid flow path P; the thick solid-line arrow and the thick dashed-line arrow denote the flow of gas in the gas flow path Q. The thick solid-line arrow indicates the case where the pressure in the gas flow path Q is increased; the thick dashed-line arrow indicates the case where the pressure in the gas flow path Q is decreased.

A buffer chamber 40 is formed at a midpoint of each liquid flow path P. The buffer chambers 40 in this embodiment serve as tank chambers that communicate with or shut off the liquid flow paths P. The features of the buffer chamber 40 are not just limited to this, however; the buffer chamber 40 may have a feature that enables the flow rate of ink that circulates in the liquid flow path P to be adjusted. The second member 36 has recessed portions 362 formed therein, which are constituent parts of the buffer chambers 40; these recessed portions are arranged in the X direction of the second member 36. Each recessed portion 362 opens on the first member 34 side; the opening of the recessed portion 362 is closed by stacking the first member 34 on the second member 36. A space is formed between the first member 34 and the second member 36; this space, which is enclosed by the recessed portion 362 and the first member 34, functions as the buffer chamber 40.

A flexible member 42, which is capable of deforming to the positive-Z-direction side and the negative-Z-direction side, is installed in each buffer chamber 40. The flexible member 42 is, for example, a diaphragm, composed of a resin material, a rubber material, or another material. The flexible members 42 are arranged in the X direction of the first member 34, facing the corresponding recessed portion 362; the flexible members 42 are held between the first member 34 and the second member 36 which is stacked on the first member 34. Thus, each flexible member 42 faces the bottom surface of the corresponding recessed portion 362. The bottom surface of the recessed portion 362 serves as a facing surface 363 of the flexible member 42. An elastic body 50 is interposed between each flexible member 42 and the facing surface 363. The elastic body 50 in the first embodiment is formed as a coil spring; it urges the flexible member 42 toward the positive-Z-direction side (in a direction in which the flexible member 42 moves away from the facing surface 363). The elastic body 50 is not limited to a coil spring, however.

Figure 3:
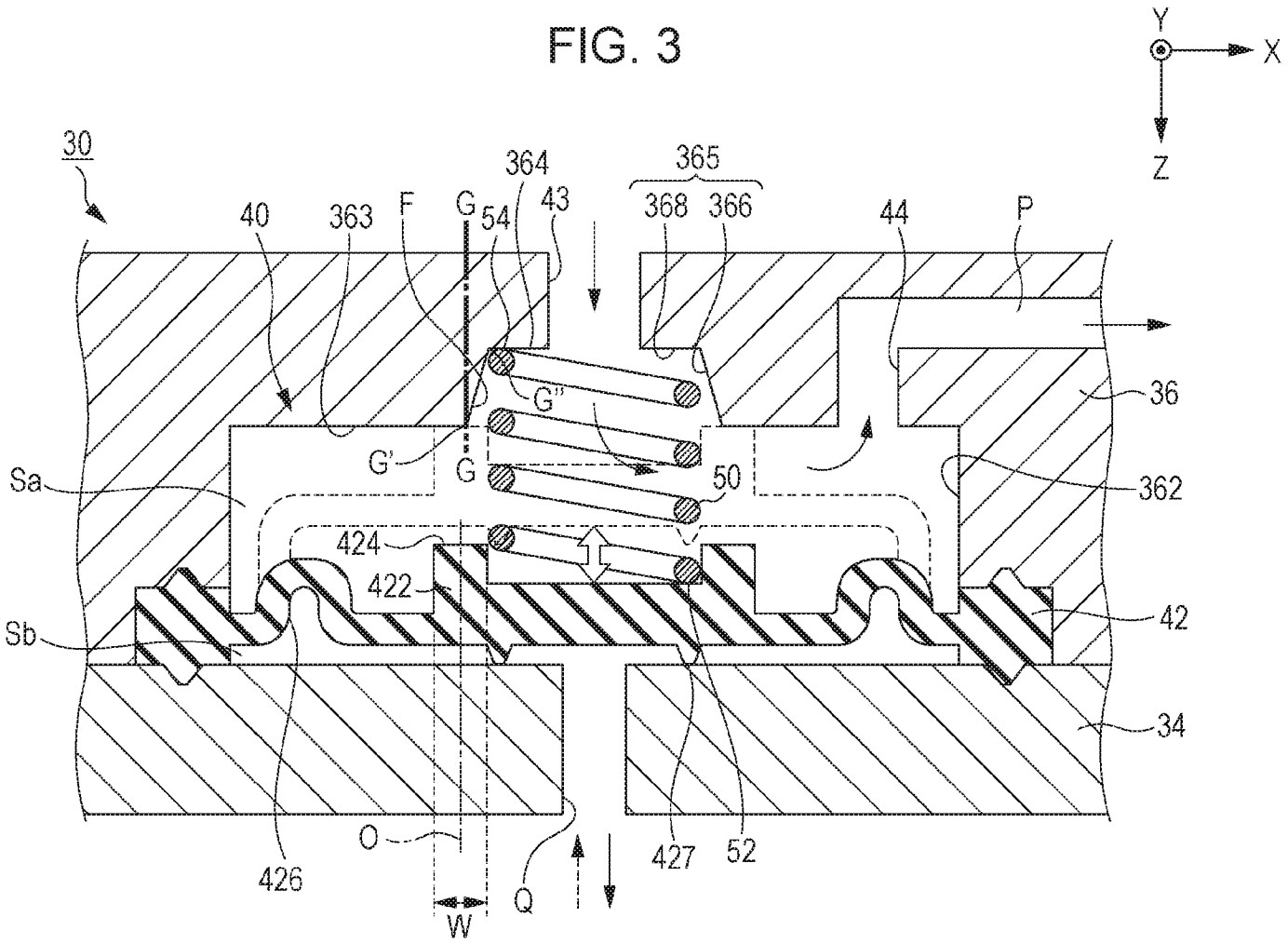
FIG. 3 is an enlarged cross-sectional view of region III in FIG. 2, illustrating the structure of a buffer chamber.

FIG. 3 is an enlarged cross-sectional view of region III in FIG. 2, illustrating the structure of one of the buffer chambers 40. Since the structure of the buffer chambers 40 is the same, the buffer chamber 40 in region III is explained as a representative one here. As illustrated in FIG. 3, the buffer chamber 40 is divided into a liquid chamber Sa and a gas chamber Sb by the flexible member 42. The liquid chamber Sa communicates with an inlet 43 of ink and an outlet 44 of ink. Ink from the liquid container 14 flows into the inlet 43, flows in a direction indicated by the arrow in FIG. 3, and flows out from the outlet 44. The ink flowing out of the outlet 44 is supplied to the liquid ejecting section 32.

A first support portion 422 is formed on the flexible member 42 to support one end 52 of the elastic body (an end on the positive-Z-direction side). On the other hand, a second support portion 364 is formed on the facing surface 363 to support the other end 54 of the elastic body (an end on the negative-Z-direction side). The second support portion 364 in this embodiment has a recess 365 formed on the facing surface 363. The recess 365, which has a side surface 366 and a bottom surface 368, opens on the facing surface 363. The other end 54 of the elastic body 50 is inserted into the recess 365 from an opening on the facing surface 363 side and abuts against the bottom surface 368, thus supporting the elastic body 50 at a predetermined fixed position. The above-described inlet 43 has penetrated through the bottom surface 368; the other end 54 of the elastic body 50 abuts against the periphery of the inlet 43.

A tapered portion (inclined surface) F, which inclines with an increasing diameter toward the facing surface 363 side, is formed on the side surface 366 of the recess 365. In this embodiment, the tapered portion F is formed entirely on the side surface 366 of the recess 365; however, it may be formed on part of the side surface 366 of the recess 365. Since, in this embodiment, the tapered portion F is formed entirely on the side surface 366, it is possible to guide the other end 54 of the elastic body 50 toward the bottom surface 368 of the recess 365 when the elastic body 50 is inserted into the recess 365 even in the case where its position is shifted during installation of the elastic body 50.

A protruding portion 424 that protrudes from the flexible member 42 toward the facing surface 363 side is formed on the first support portion 422. The protruding portion 424 in this embodiment stands up so as to surround the outer periphery of the one end 52 of the elastic body 50; the one end 52 of the elastic body 50 is inserted into and supported by an inner side of the protruding portion 424. The protruding portion 424 becomes interposed between the flexible member 42 and the facing surface 363 around the periphery of the recess 365 when the flexible member 42 is flexibly bent toward the facing surface 363 as illustrated by the dashed line in FIG. 3. Since, in this embodiment, the protruding portion 424 is formed in this way, it is possible to prevent the flexible member 42 from clinging to the facing surface 363 when the flexible member 42 is flexibly bent toward the facing surface 363. The protruding portion 424 blocks the opening of the recess 365 when it abuts against the facing surface 363; this blockage shuts off the liquid flow path P and stops the flow of ink from the inlet 43 toward the outlet 44 (the flow indicated by the arrow in FIG. 3).

In FIG. 3, assuming a line G-G in the Z direction that passes through an opening edge G' of the recess 365, the protruding portion 424 has a width W across the opening edge G' of the recess 365 from the inner side to the outer side of the opening edge G'. In plan view in the Z direction (in plan view in a direction in which the first member 34 and the second member 36 are stacked), the center O of the width W of the protruding portion 424 is outside the opening edge G' of the recess 365. In such a configuration, the center O of the width W of the protruding portion 424 can always be brought into abutment with the outside of the opening edge G' of the recess 365 when the protruding portion 424 abuts against the periphery of the recess 365 as illustrated by the dashed line in FIG. 3. If the center O of the width W of the protruding portion 424 is inside the opening edge G' of the recess 365, the protruding portion 424 is likely to incline inwardly and may enter the recess 365. Since, in this embodiment, the center O of the width W of the protruding portion 424 is outside the opening edge G' of the recess 365, the protruding portion 424 is less likely to incline inwardly from the opening edge G' when the protruding portion 424 abuts against the opening edge G'. It is thus less likely that the protruding portion 424 will enter the recess 365.

The gas chamber Sb communicates with the gas flow path Q, which communicates with the pressure adjusting section 28. In the first embodiment, the pressure adjusting section 28, which has a function that increases or decreases atmospheric pressure in the gas chamber Sb, typically includes a pneumatic pump. The pressure adjusting section 28 changes the atmospheric pressure in the gas chamber Sb to flexibly bend the flexible member 42; this change can cause the flexible member 42 to be deformed to a communicative position at the positive-Z-direction side (a position indicated by the solid line) or to a blockage position at the negative-Z-direction side (a position indicated by the dashed line). When the flexible member 42 is displaced at the blockage position at the negative-Z-direction side, the protruding portion 424 abuts against the facing surface 363 and blocks the opening of the recess 365; this operation shuts off the liquid flow path P and can stop supply of ink to the liquid ejecting section 32. On the other hand, when the flexible member 42 is displaced at the communicative position at the positive-Z-direction side, the protruding portion 424 moves away from the facing surface 363 and the recess 365 opens; this operation enables the liquid flow path P to communicate and ink to be supplied to the liquid ejecting section 32. As illustrated in FIG. 3, there is the option to form a thin portion 426 on the flexible member 42 to make the flexible member 42 easy to bend flexibly. Additionally, forming a projection 427 that projects to the first member 34 side on the flexible member 42 can also prevent the flexible member 42 from clinging to the first member 34 when the flexible member 42 is flexibly bent toward the first member 34.

Figure 4A:
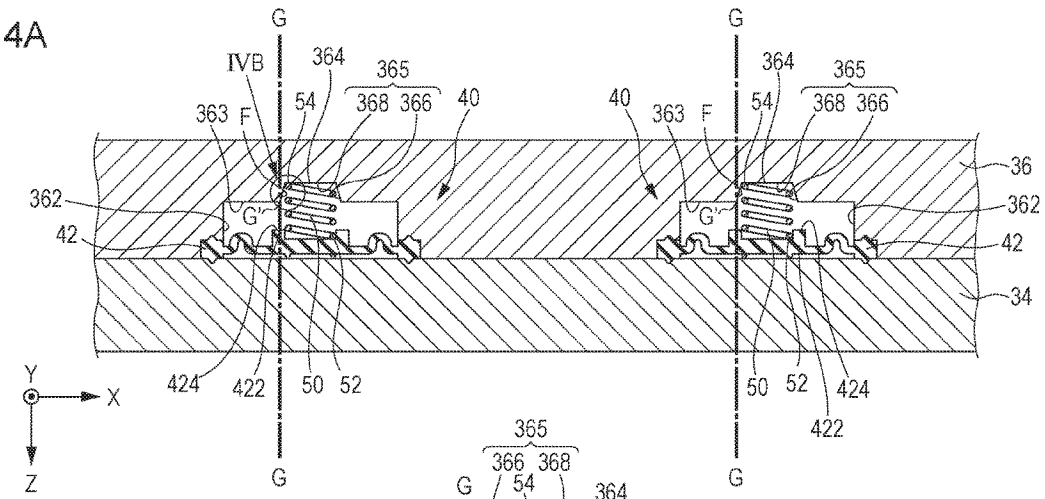
FIG. 4A is a view illustrating an operation when an elastic body is installed in a liquid ejecting head according to the first embodiment of the invention.
Figure 4B:
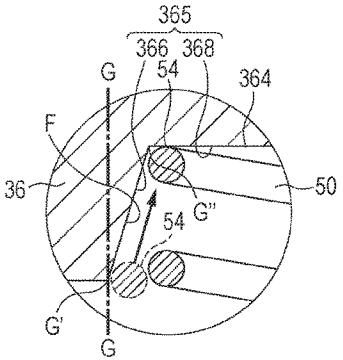
FIG. 4B is an enlarged view of region IVB in FIG. 4A.
Figure 5A:
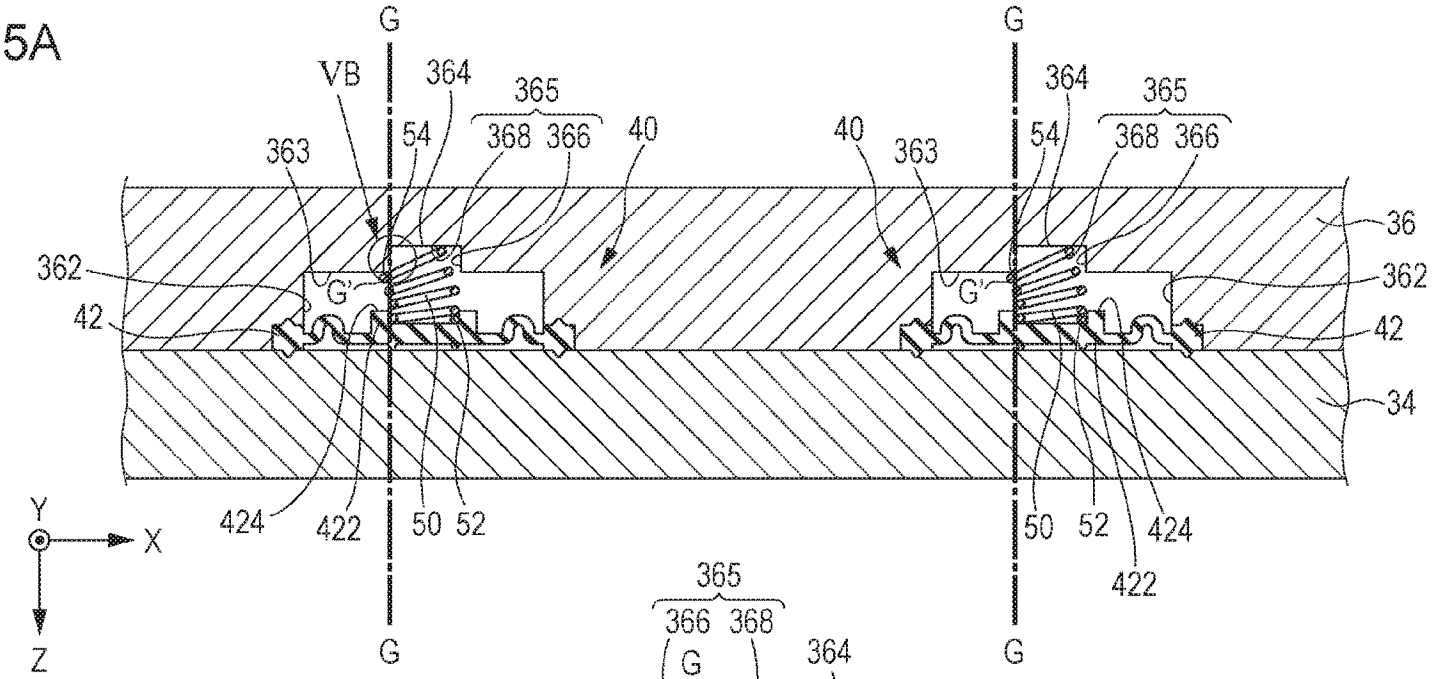
FIG. 5A is a view illustrating an operation when an elastic body is installed in a liquid ejecting head according to a first comparative example.
Figure 5B:
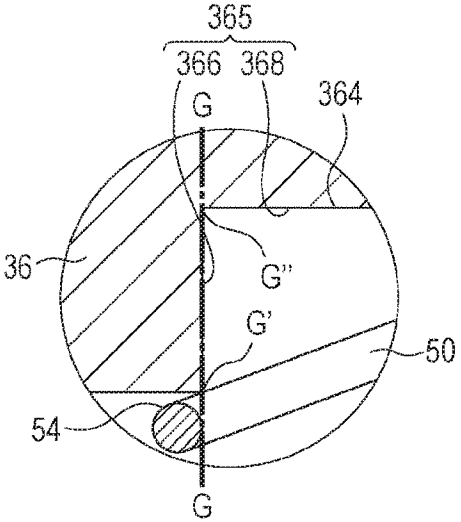
FIG. 5B is an enlarged view of region VB in FIG. 5A.

Next, an operation in the first embodiment in which a plurality of elastic bodies 50 are installed by stacking the first member 34 and the second member 36 will be described with reference to a first comparative example. FIG. 4A and FIG. 4B are cross-sectional views illustrating an operation in which the elastic body 50 is installed in the liquid ejecting head 30 according to the first embodiment having the tapered portion F. FIG. 4A is a cross-sectional view of the liquid ejecting head 30 in the first embodiment; FIG. 4B is an enlarged view of region IVB in FIG. 4A. FIG. 5A and FIG. 5B are cross-sectional views illustrating an operation in which the elastic body 50 is installed in the liquid ejecting head 30 according to the first comparative example not having the tapered portion F. FIG. 5A is a cross-sectional view of the liquid ejecting head 30 according to the first comparative example; FIG. 5B is an enlarged view of region VB in FIG. 5A. In FIG. 4A and FIG. 5A, the liquid flow path P and the gas flow path Q are omitted for simplicity of explanation.

In the first embodiment in FIG. 4A and FIG. 4B, assuming a line G-G in the Z direction that passes through the opening edge G' of the recess 365 similarly as in FIG. 3, the line G-G passes outside a boundary G" between the side surface 366 and the bottom surface 368; the tapered portion F is formed from the opening edge G' to the boundary G". In the first embodiment in this state, the second member 36 is stacked on the first member 34 with the one end 52 of each elastic body 50 being supported by the first support portion 422 of the corresponding flexible member 42. In this case, even when the other end 54 is shifted outside the boundary G" as indicated by the dashed line in FIG. 4B, the other end 54 of the elastic body 50 to be inserted into the recess 365 will be guided along the tapered portion F toward the bottom surface 368 as illustrated by the arrow; the elastic body 50 can always be installed at a predetermined fixed position.

On the other hand, in the first comparative example in FIG. 5A and FIG. 5B, the recess 365 does not have the tapered portion F and the line G-G passes through both the opening edge G' and the boundary G". In the first comparative example in this state, the second member 36 is stacked on the first member 34 with the one end 52 of each elastic body 50 being supported by the first support portion 422 of the corresponding flexible member 42. In this case, when the other end 54 of the elastic body 50 to be inserted into the recess 365 is shifted outside the boundary G" as indicated in FIG. 5B, it will result in a faulty installation. This error is caused by the fact the elastic body 50 becomes oblique by the other end 54 being caught by the opening edge G' of the recess 365 because the recess 365 does not have the tapered portion F.

Especially when a plurality of elastic bodies 50 are installed at the same time, even in the state in which the one end 52 of the elastic body 50 is supported by the first support portion 422, the orientation of the other end 54 may vary, so, in the comparative example not having the tapered portion F, a faulty installation is likely to occur. In contrast, in the first embodiment, even when the other ends 54 of the elastic bodies 50 vary somewhat in orientation, the above-described tapered portion F enables easy installation of all the elastic bodies 50 normally. This operation can facilitate installation of the elastic bodies when the plurality of elastic bodies 50 are installed at the same time.

Figure 6:
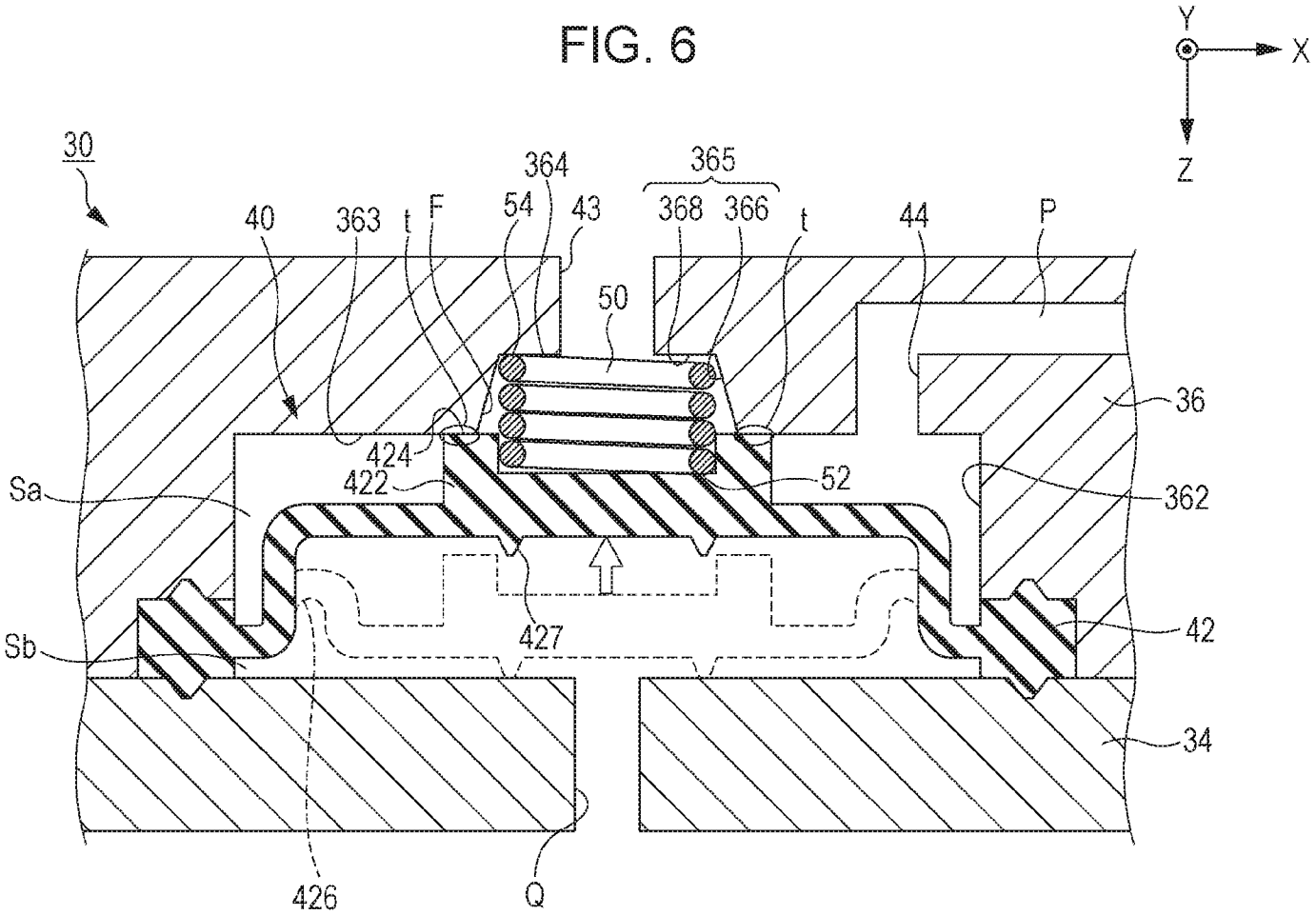
FIG. 6 is a view illustrating an operation of a buffer chamber in the liquid ejecting head according to the first embodiment of the invention.
Figure 7:
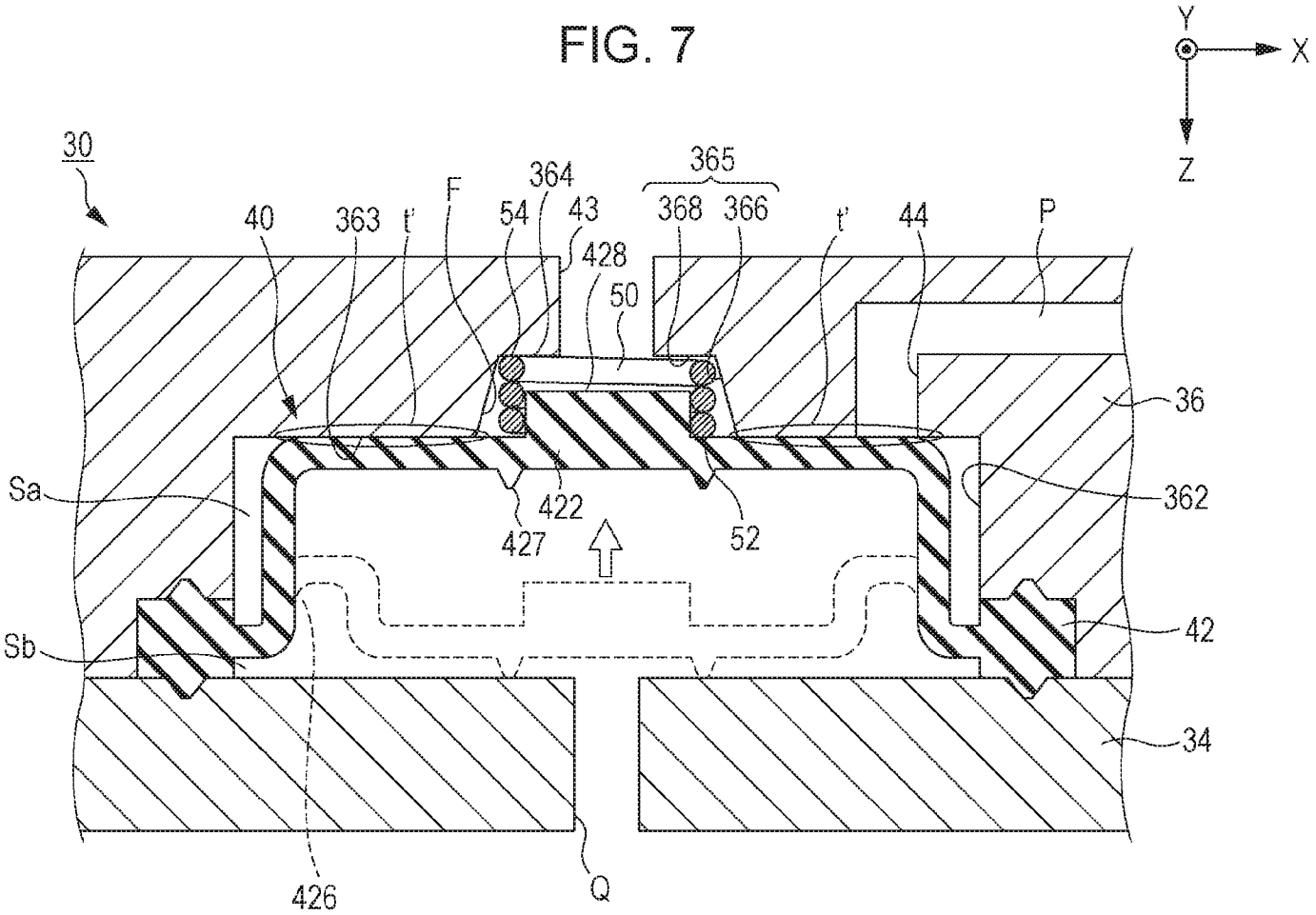
FIG. 7 is a view illustrating an operation of a buffer chamber in a liquid ejecting head according to a second comparative example.

Next, an operation of the buffer chamber 40 in the first embodiment will be described with reference to a second comparative example. FIG. 6 and FIG. 7 are cross-sectional views illustrating an operation of the buffer chamber 40. FIG. 6 is a view illustrating an operation of the first embodiment having the protruding portion 424 that abuts against the periphery of the recess 365; FIG. 7 is a view illustrating an operation of the second comparative example not having the protruding portion 424 that abuts against the periphery of the recess 365.

The protruding portion 424 that abuts against the periphery of the recess 365 is formed on the first support portion 422 in the first embodiment in FIG. 6 so as to surround the outer periphery of the one end 52 of the elastic body 50. In the first embodiment in this state, when the flexible member 42 is flexibly bent toward the facing surface 363, the protruding portion 424 abuts against the periphery of the recess 365, in which case it is possible to prevent other areas of the flexible member 42 from abutting against the facing surface 363. This configuration can prevent the flexible member 42 from clinging to the facing surface 363.

On the other hand, the first support portion 422 in the second comparative example in FIG. 7 does not have the protruding portion 424 that abuts against the periphery of the recess 365; a protruding portion 428 is formed that is inserted into the inner side of the one end 52 of the elastic body 50. In the second comparative example in this state, when the flexible member 42 is flexibly bent toward the facing surface 363, the protruding portion 428 is also inserted into the inside of the recess 365 together with the other end 54 of the elastic body 50. Thus, in the configuration in the second comparative example, the flexible member 42 and the facing surface 363 come into contact in a wide range (contact portions t'), which means that the contact area is very large. The flexible member 42 is likely to cling to the facing surface 363. By contrast, in the first embodiment as illustrated in FIG. 6, the flexible member 42 makes contact with the facing surface 363 only at the contact portions t between the protruding portion 424 and the facing surface 363, which means that the contact area in this case can be much smaller than the area of the contact portions t' illustrated in FIG. 7. Providing the protruding portion 424 that abuts against the periphery of the recess 365 can substantially prevent the flexible member 42 from clinging to the facing surface 363, compared to the case where the protruding portion 424 is not provided.

As detailed above, in the liquid ejecting head 30 according to the first embodiment, the tapered portion F that guides the other end 54 of the elastic body 50 toward the bottom surface 368 of the recess 365 is formed on the side surface 366 of the recess 365 on the second support portion 364. Thus, even when shifted in position, the other end 54 of the elastic body 50 is guided along the tapered portion F toward the bottom surface 368, thereby enabling the elastic body 50 to be installed normally. In addition, the protruding portion 424 is disposed so as to become interposed between the flexible member 42 and the facing surface 363 around the periphery of the recess 365 when the flexible member 42 is flexibly bent toward the facing surface 363. This disposition can prevent the flexible member 42 from clinging to the facing surface 363 when the flexible member 42 is flexibly bent toward the facing surface 363. As a result, the apparatus according to the first embodiment can facilitate installation of the elastic body 50 while preventing clinging of the flexible member 42. Moreover, in the first embodiment, providing the protruding portion 424 on the first support portion 422 can support the one end 52 of the elastic body 50 on the inside of the protruding portion 424. In this configuration, a separate structure does not need to be provided on the first support portion 422 in order to support the one end 52 of the elastic body 50.

Second Embodiment

Figure 8:
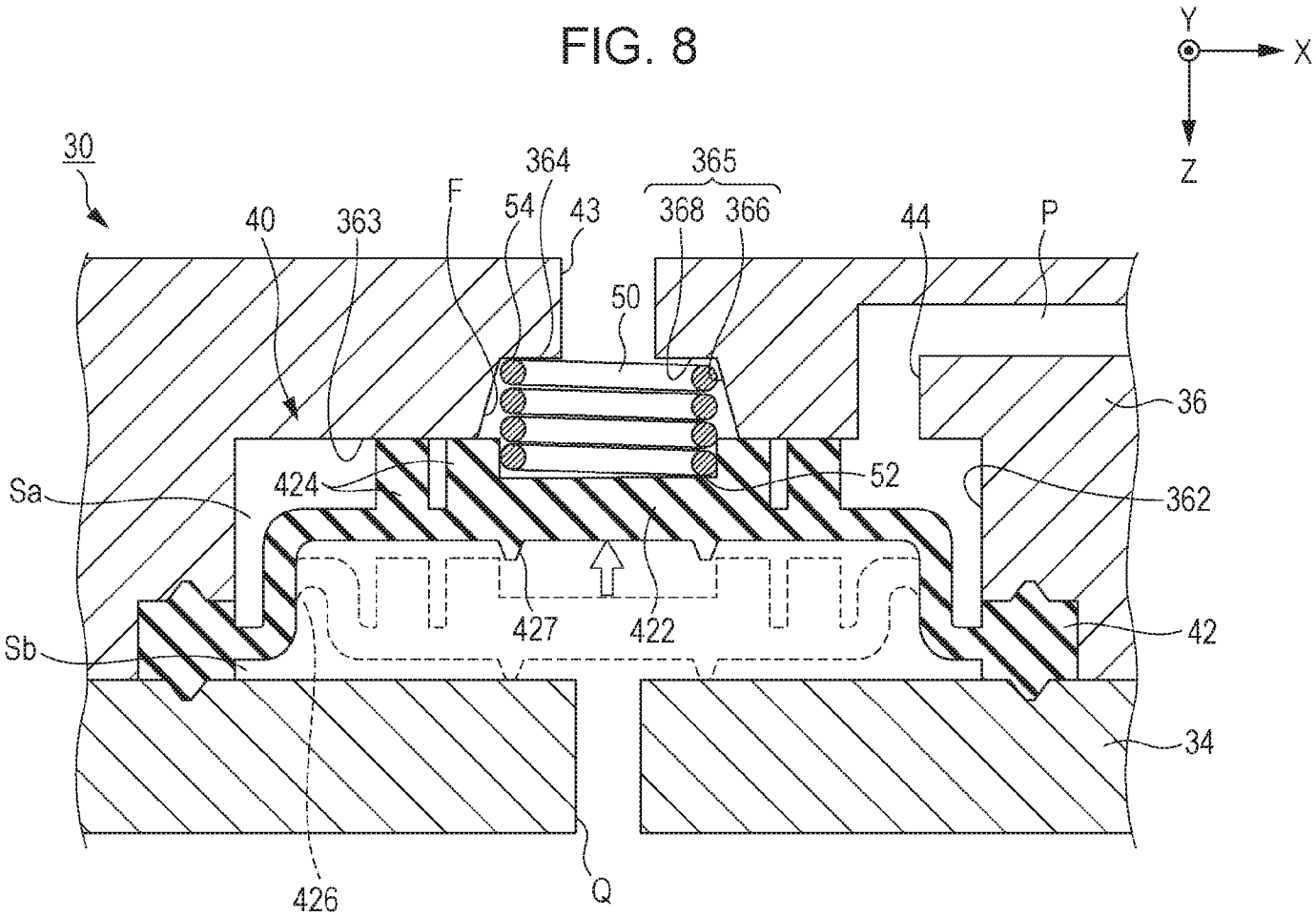
FIG. 8 is a cross-sectional view illustrating the structure of a buffer chamber in a liquid ejecting head according to a second embodiment of the invention.

A second embodiment of the invention will now be described. In embodiments described below, like elements having the same operation and function as those in the first embodiment may be denoted by like numbers used in the descriptions in the first embodiment; each detailed explanation will be omitted as appropriate. FIG. 8, which corresponds to FIG. 3, is a cross-sectional view illustrating the structure of a buffer chamber 40 in a liquid ejecting head 30 according to the second embodiment. In the exemplary configuration illustrated in FIG. 3, the protruding portion 424 is provided on the first support portion 422, but the invention is not limited to this configuration. As illustrated in FIG. 8, an additional protruding portion 424 may be provided on the outside of a first support portion 422.

According to the configuration in FIG. 8, when a flexible member 42 is flexibly bent toward a facing surface 363, the protruding portion 424 on the first support portion 422 and the additional protruding portion 424 on the outside of the first support portion 422 abut against the periphery of a recess 365, in which case it is possible to prevent other areas of the flexible member 42 from abutting against the facing surface 363. This configuration can prevent the flexible member 42 from clinging to the facing surface 363. Furthermore, the additional protruding portion 424 on the outside of the first support portion 422 is brought into abutment with the outside of the opening edge G' of the recess 365; it is less likely that the protruding portion 424 on the first support portion 422 will incline inwardly from the opening edge G' of the recess 365. It is thus possible to prevent the protruding portion 424 on the first support portion 422 from entering the recess 365. In the configuration in FIG. 8, it is possible to prevent the flexible member 42 from clinging to the facing surface 363 by use of only the protruding portion 424 on the outside of the first support portion 422 without the need to provide the protruding portion 424 on the first support portion 422. The number of additional protruding portions 424 is not limited as described above; two or more additional protruding portions 424 may be provided on the outside of the first support portion 422.

Third Embodiment

Figure 9:
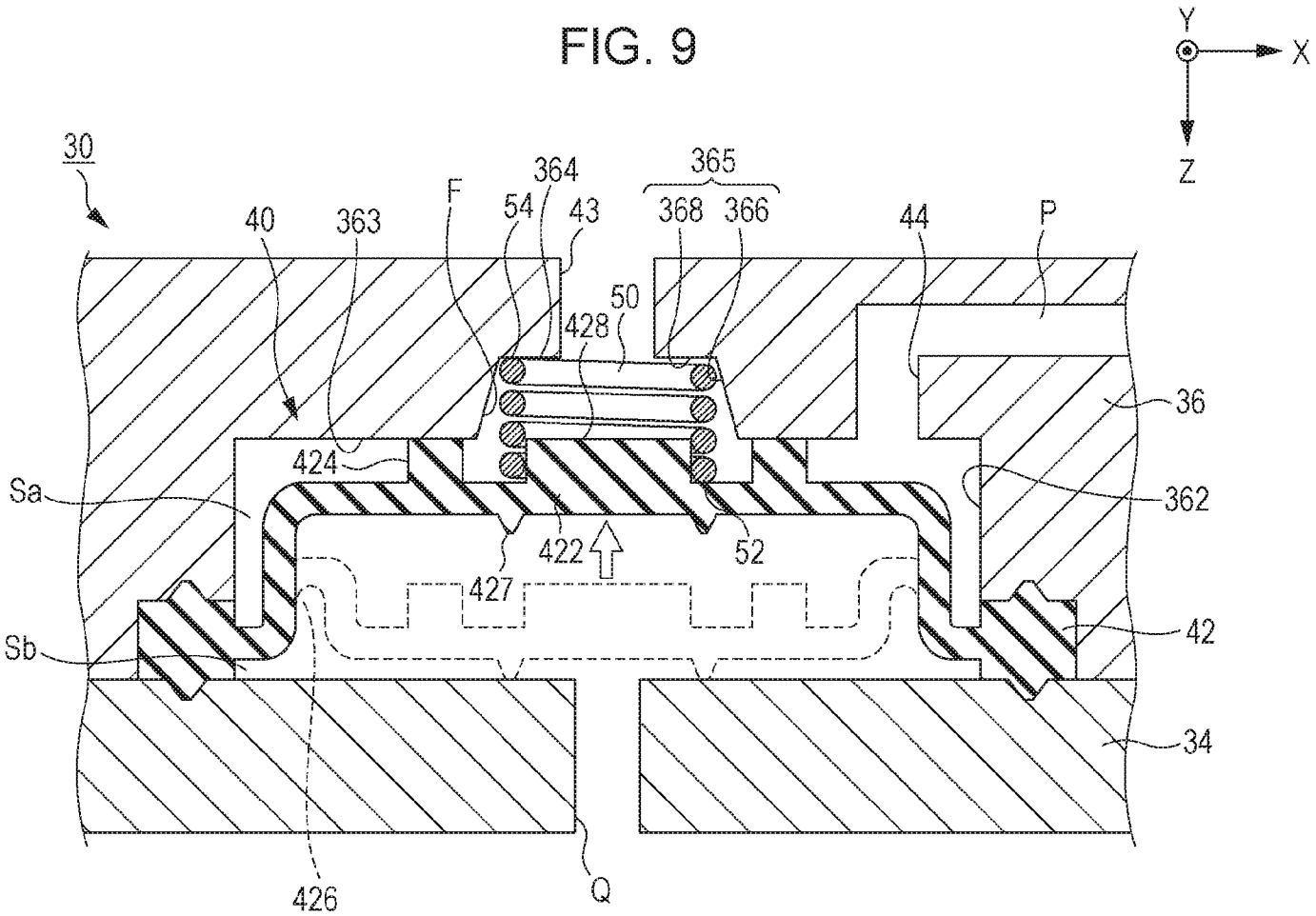
FIG. 9 is a cross-sectional view illustrating the structure of a buffer chamber in a liquid ejecting head according to a third embodiment of the invention.

A third embodiment of the invention will now be described. FIG. 9, which corresponds to FIG. 3, is a cross-sectional view illustrating the structure of a buffer chamber 40 in a liquid ejecting head 30 according to the third embodiment. In the exemplary configuration illustrated in FIG. 3, the protruding portion 424 is provided on the first support portion 422, but the invention is not limited to this configuration. As illustrated in FIG. 9, a protruding portion 424 may be provided at a different location from a first support portion 422. Similarly to the second comparative example in FIG. 7, a protruding portion 428 that is inserted into the inner side of one end 52 of an elastic body 50 is formed on the first support portion 422 in FIG. 9. In plan view in the Z direction, the protruding portion 424 in FIG. 9 is placed outside by being spaced away from the first support portion 422.

According to the configuration in FIG. 9, when a flexible member 42 is flexibly bent toward a facing surface 363, the protruding portion 424 on the outside of the first support portion 422 abuts against the periphery of a recess 365, in which case it is possible to prevent other areas of the flexible member 42 from abutting against the facing surface 363. This configuration can prevent the flexible member 42 from clinging to the facing surface 363. Also in the second comparative example in FIG. 7, it is possible to prevent the flexible member 42 from clinging to the facing surface 363 by providing the protruding portion 424 as illustrated in FIG. 9.

Fourth Embodiment

Figure 10:
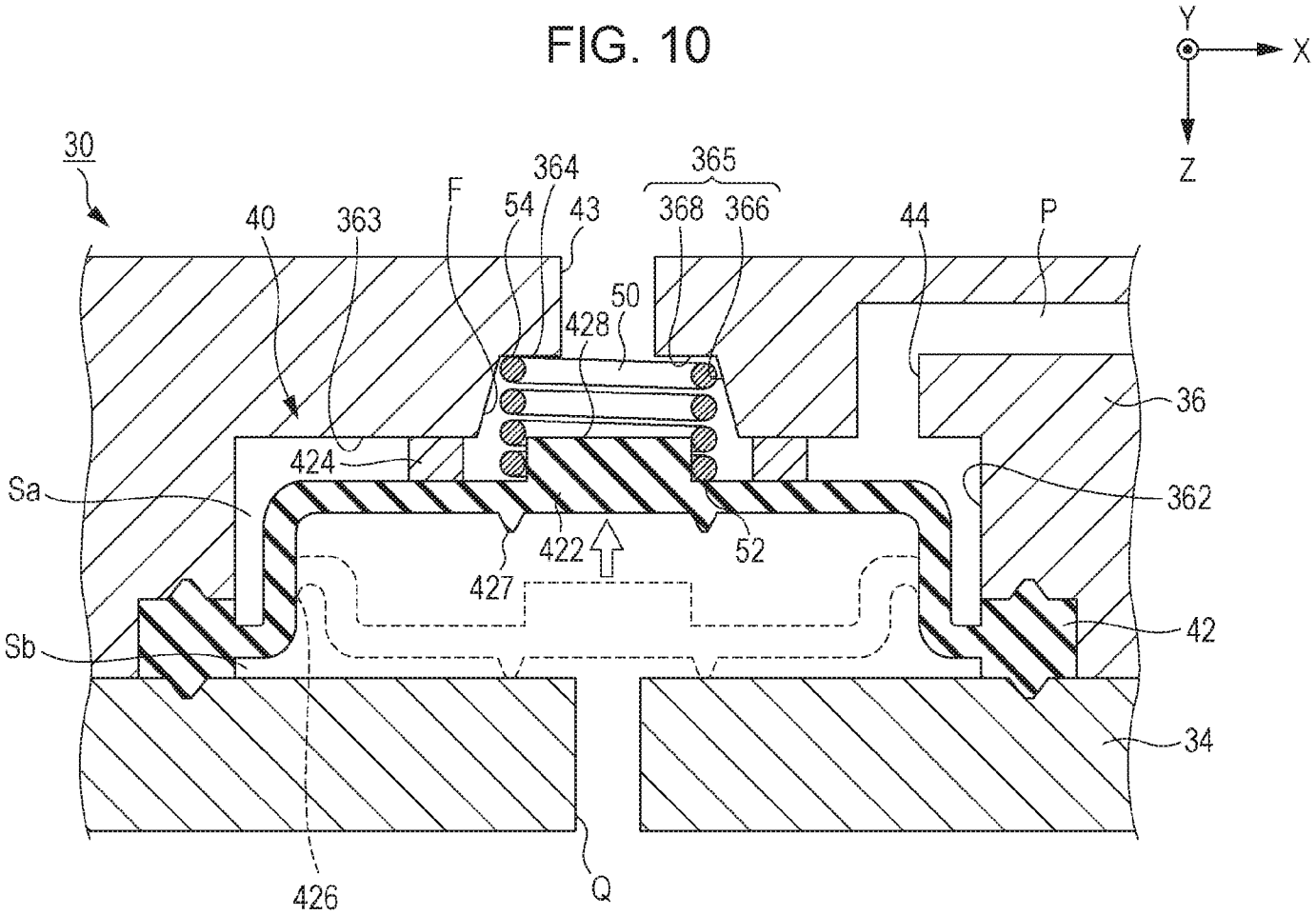
FIG. 10 is a cross-sectional view illustrating the structure of a buffer chamber in a liquid ejecting head according to a fourth embodiment of the invention.

A fourth embodiment of the invention will now be described. FIG. 10, which corresponds to FIG. 9, is a cross-sectional view illustrating the structure of a buffer chamber 40 in a liquid ejecting head 30 according to the fourth embodiment. In the exemplary configuration illustrated in FIG. 9, the protruding portion 424 is provided on the flexible member 42, but the invention is not limited to this configuration. As illustrated in FIG. 10, a protruding portion 424 may be provided on the facing surface 363. Also in the configuration in FIG. 10, when a flexible member 42 is flexibly bent toward a facing surface 363, the protruding portion 424 becomes interposed between the flexible member 42 and the facing surface 363; it is possible to prevent the flexible member 42 from abutting against the facing surface 363. This configuration can prevent the flexible member 42 from clinging to the facing surface 363. Moreover, the protruding portion 424 may be a different member. Forming the protruding portion 424 by using a different member means that it is possible to form the protruding portion 424 by using a material which is less likely to cling to the facing surface 363 than the flexible member 42 is.

Modified Examples

The above-described embodiments can be modified in various ways. Specific modified examples will be described below. Any two or more of the following examples can be merged as appropriate unless they are inconsistent with each other.

(1) In the above-described embodiments, the invention is applied to the exemplary configuration in which the elastic bodies 50 are installed in the plurality of buffer chambers 40 formed by stacking the first member 34 and the second member 36, but the invention is not limited to this configuration. The invention can be applied to a variety of chambers and apparatuses, into which the elastic bodies 50 are installed, which are formed by stacking the first member 34 and the second member 36. An example other than the buffer chamber 40 includes a valve apparatus or the like in which an elastic body that urges a valve body, for example, is provided.

(2) In the above-described embodiments, a serial head that repeatedly reciprocates, in the X direction, the carriage 26 on which a plurality of liquid ejecting heads 30 are mounted is used as an example, but the invention is also applicable to a line head in which the liquid ejecting head 30 is arranged entirely across the width of the medium 12. The method by which the liquid ejecting head 30 ejects ink is not limited to the above-described method (a piezo method) that uses piezoelectric elements. For example, the invention can also be applied to a liquid ejecting head in accordance with the method (a thermal method) that uses heating elements to change the pressure in a pressure chamber by generating air bubbles in the chamber with the application of heat.

(3) The exemplary printing apparatus in the above embodiments can be used for various kinds of devices such as a facsimile apparatus, a copier, and the like in addition to an apparatus specific to printing. Note that the use of the liquid ejecting apparatus according to the embodiments of the invention is not limited to printing. For example, a liquid ejecting apparatus that ejects a colorant solution can be used as a manufacturing apparatus that forms color filters for a liquid crystal display. Alternatively, a liquid ejecting apparatus that ejects a conductive material solution may be used as a manufacturing apparatus that forms wiring patterns and electrodes on a wiring board.

The entire disclosure of Japanese Patent Application No. 2016-054947, filed Mar. 18, 2016 is expressly incorporated by reference herein.

What is claimed is:

1. A liquid ejecting head comprising:

a first member on which a plurality of flexible members are arranged;

a second member having a facing surface that faces each flexible member of the plurality of flexible members, the second member being stacked on the first member;

an elastic body that is interposed between the flexible member and the facing surface;

a first support portion that supports one end of the elastic body, the first support portion being disposed on the flexible member;

a second support portion that supports another end of the elastic body, the second support portion being disposed on the facing surface; and a protruding portion that is disposed on the flexible member or on the facing surface;

wherein the second support portion has a recess into which the other end of the elastic body is inserted, wherein a side surface of the recess has a tapered portion formed therein to guide the other end of the elastic body toward a bottom surface of the recess, and wherein the protruding portion becomes interposed between the flexible member and the facing surface around a periphery of the recess when the flexible member is flexibly bent toward the facing surface.

2. The liquid ejecting head according to claim 1, wherein the protruding portion has a width across an opening edge of the recess from an inner side to an outer side of the opening edge with a center of the width of the protruding portion being outside the opening edge of the recess.

3. A liquid ejecting apparatus comprising the liquid ejecting head according to claim 2.

4. The liquid ejecting head according to claim 1, wherein the protruding portion is disposed so as to protrude from the flexible member and abuts against the periphery of the recess when the flexible member is flexibly bent toward the facing surface.

5. A liquid ejecting apparatus comprising the liquid ejecting head according to claim 4.

6. The liquid ejecting head according to claim 1, wherein the protruding portion is disposed on the first support portion to support the one end of the elastic body.

7. A liquid ejecting apparatus comprising the liquid ejecting head according to claim 6.

8. The liquid ejecting head according to claim 1, wherein the protruding portion is placed outside the first support portion and is brought into abutment outward away from the opening edge of the recess.

9. A liquid ejecting apparatus comprising the liquid ejecting head according to claim 8.

10. The liquid ejecting head according to claim 1, wherein the protruding portion is placed outside the first support portion and is brought into abutment outward away from the recess.

11. A liquid ejecting apparatus comprising the liquid ejecting head according to claim 10.

12. A liquid ejecting apparatus comprising the liquid ejecting head according to claim 1.

13. A liquid ejecting head comprising:

a first member on which a flexible member is arranged;

a second member having a facing surface that faces the flexible member, the second member being stacked on the first member;

an elastic body that is interposed between the flexible member and the facing surface;

a first support portion that supports one end of the elastic body, the first support portion being disposed on the flexible member;

a second support portion that supports another end of the elastic body, the second support portion being disposed on the facing surface; and a protruding portion that is disposed on the flexible member or on the facing surface;

wherein the second support portion has a recess into which the other end of the elastic body is inserted, wherein a side surface of the recess has a tapered portion formed therein to guide the other end of the elastic body toward a bottom surface of the recess, and wherein the protruding portion becomes interposed between the flexible member and the facing surface around a periphery of the recess when the flexible member is flexibly bent toward the facing surface.

14. The liquid ejecting head according to claim 13, wherein the protruding portion has a width across an opening edge of the recess from an inner side to an outer side of the recess with a center of the width of the protruding portion being outside of the recess.

15. A liquid ejecting apparatus comprising the liquid ejecting head according to claim 14.

16. The liquid ejecting head according to claim 13, wherein the protruding portion is disposed so as to protrude from the flexible member and abuts against the periphery of the recess when the flexible member is flexibly bent toward the facing surface.

17. A liquid ejecting apparatus comprising the liquid ejecting head according to claim 16.

18. The liquid ejecting head according to claim 13, wherein the protruding portion is disposed on the first support portion to support the one end of the elastic body.

19. A liquid ejecting apparatus comprising the liquid ejecting head according to claim 18.

20. A liquid ejecting apparatus comprising the liquid ejecting head according to claim 13.

* * * * *